United States Patent [19]

Russell

[11] Patent Number: 4,603,851

[45] Date of Patent: Aug. 5, 1986

[54] PORTABLE EXERCISING DEVICE

[76] Inventor: Brian Russell, 11715 Keough Dr., Northglenn, Colo. 80233

[21] Appl. No.: 757,299

[22] Filed: Jul. 22, 1985

[51] Int. Cl.[4] ..... A63B 23/04

[52] U.S. Cl. ..... 272/96; 272/70; 272/93

[58] Field of Search ..... 272/70, 69, 96, 93, 272/111, 65; 128/25 R, 25 B, 68; 5/481, 474, 345, 443, 444; 297/458; D21/192

[56] References Cited

U.S. PATENT DOCUMENTS

| | | | |
|---|---|---|---|
| 1,931,146 | 10/1933 | Hampel | 272/96 X |
| 2,820,454 | 1/1958 | Wright | 128/25 R |
| 3,434,715 | 3/1969 | Brantingham et al. | 272/96 X |
| 3,566,423 | 3/1971 | Reinfeldt | 5/474 |
| 3,627,313 | 12/1971 | Schonfeld | 272/70 X |
| 3,634,895 | 1/1972 | Childers | 5/345 |
| 3,641,601 | 2/1972 | Sieg | 272/65 X |
| 4,159,826 | 7/1979 | Hancock | 272/65 |
| 4,253,661 | 3/1981 | Russell | 272/96 |
| 4,403,356 | 9/1983 | Urai | 5/481 |

*Primary Examiner*—Richard J. Apley
*Assistant Examiner*—J. Welsh
*Attorney, Agent, or Firm*—John E. Reilly

[57] ABSTRACT

An exercise unit for in-place exercising includes a unitary structure having a common base member with upwardly directed pads separated by a common groove, each pad terminating in an upper foot-engaging ribbed surface surrounded by a raised ledge and generally convex sidewalls and end walls which slope downwardly from the upper ribbed surfaces into the base so as to more effectively control the resistance through compression of the pads when various exercises are performed.

14 Claims, 5 Drawing Figures

PORTABLE EXERCISING DEVICE

This invention relates to a novel and improved portable, self-contained device for exercising the lower extremities including the lower back, abdominal and buttocks regions as well as the legs, ankles and feet.

BACKGROUND AND FIELD OF THE INVENTION

A wide assortment of exercise devices have been developed in recent years, spurred on by increasing interest in physical fitness and conditioning. The device of the present invention is an exercise unit which is extremely compact and portable and which is equally suitable for use in organized health or fitness centers as well as in-home use and which will permit a board range of exercises to be performed by an individual safely within a limited area. Previously, as disclosed in my earlier U.S. Pat. No. 4,253,661, I devised an exercise device made up of a thick pad of resilient foam material having a thickness on the order of 6" to 9", and a lower surface or base adapted to rest on a flat supporting surface, such as, a floor. An upper foot-engaging surface is sloped downwardly at a low angle from its maximum thickness, the front and rear sides of the pad being sloped inwardly of the pad toward the upper surface to form an upper foot-engaging surface smaller than the base and a top portion of resilient material smaller than and secured on the upper surface. The separate top portion is comprised of a rectangular member of resilient foam material mounted on a rectangular base of resilient foam material having a center void so that the peripheral portions of the top portion have more resistance to compression leaving a center area of less resistance. As designed, it was possible for the exerciser to perform various jogging and running exercises through the expedient of alternately raising and lowering the feet against the pad or foot-engaging surfaces.

It has been found desirable to devise exercise units of the type disclosed in my earlier patent in such a way as to more effectively control the resistance to compression of the pad by each foot. Generally, when a flat pad surface having sides with angles at 90° undergoes compression, lateral spreading occurs so as to create an inherent instablity, since the limb or limbs will be encouraged to thrust in the direction of least muscular control. In some cases, the lack of predictability of compression of the pad may lead to possible joint or tissue injury. In my prior U.S. Pat. No. 4,253,661, I devised sloped sides in order to reduce the problem of lateral instability. Nevertheless, it was found that the sloped sides as devised did not fully overcome the lateral shearing effect at maximum deflection.

I have now devised a novel and improved exercise unit of the type described which establishes additional control over resistance to deflection and improves the control of compression and rebound rates as well as the containment of developed tension. Moreover, it is desirable to reduce the time element between the compression and rebound phases while at the same time affording proper control over lateral spreading.

Other representative patents in this field are U.S. Pat. No. 2,820,454 to Wright; U.S. Pat. No. 3,434,715 to Brantingham; U.S. Pat. No. 3,627,313 to Schonfield; U.S. Pat. No. 3,634,895 to Childers; U.S. Pat. No. 3,641,601 to Sieg; and U.S. Pat. No. 4,159,826 to Hancock.

SUMMARY OF THE INVENTION

It is therefore an object of the present invention to provide a novel and improved exercise unit which is compact and portable while permitting a wide variety of exercises to be performed within a limited area or space.

It is another object of the present invention to provide for a novel and improved exercise device of unitary construction which is particularly adaptable for use in exercising the lower limbs of the human body in such a way as to accurately simulate incurred muscular extension and retraction required by specific sporting activities including but not limited to exercise of the foot and ankle system throughout the pronation/supination positions; and further wherein the device achieves precise control over compression and rebound so as to obtain any desired pulse rate over extended time periods.

Still another object of the present invention is to provide a novel and improved exercising unit which enables more complete muscular exhaustion with minimal resultant muscular soreness and while minimizing the dangers of muscular tearing.

A further object of the present invention is to provide for a unitary exercise device characterized by permitting various exercises to be performed, such as, running or jogging in place in such a way that the feet never leave the surface of the device and wherein the amount of travel of the feet into the exercise medium, or deflection, is directly related to the effectiveness and resistance of the device.

In accordance with the present invention, there has been devised a portable, self-contained exercising unit for in-place exercising and strengthening of the lower limbs of the human body which is comprised of a pair of pad members each composed of a resilient, compressible material. A common base member unites the pad members in juxtaposed relation to one another with a deep groove extending between the pad members, and each pad member having an upper flat, foot-engaging surface formed out of and integral with each pad member, each pad member being generally rectangular in horizontal cross-section and having downwardly divergent side and end walls extending continuously from the upper rib surface to the common base, the side and end walls being interruped by generally convex bulges extending the substantial length of each of the side walls and end walls which are formed out of and integral with the pad members and converge downwardly toward the base from the upper ribbed surface. The exercise unit is of unitary construction and is composed of an open cellular foam material of uniform density throughout. The construction and arrangement of the side and end walls as described has been found to efficiently control compression rates and rebound phases while substantially increasing the lateral stability of the individual pad members.

The above and other objects, advantages and features of the present invention will become more readily appreicated and understood from the foregoing detailed description of preferred and alternate embodiments when taken together with the accompanying drawings, in which:

DETAILED DESCRIPTION OF THE PREFERRED EMBODIMENT

Figure 1:
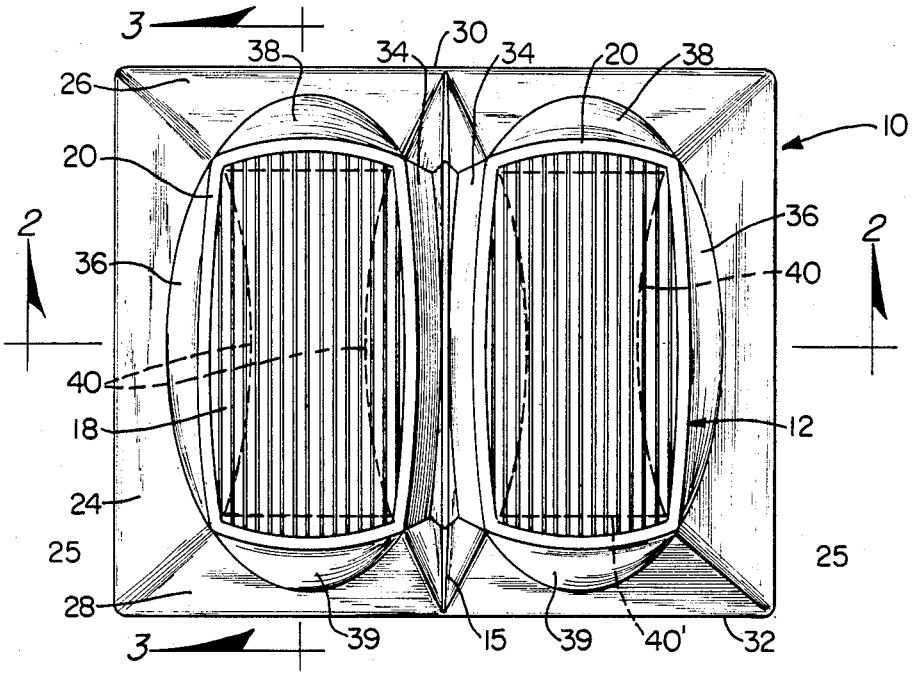
FIG. 1 is a top plan view of the preferred form of exercise unit in accordance with the present invention.
Figure 2:
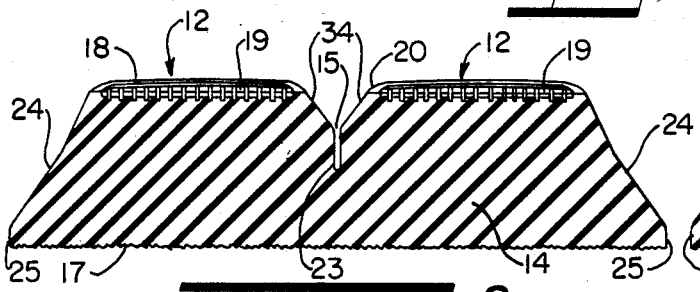
FIG. 2 is a sectional view taken about lines 2—2 of FIG. 1.
Figure 3:
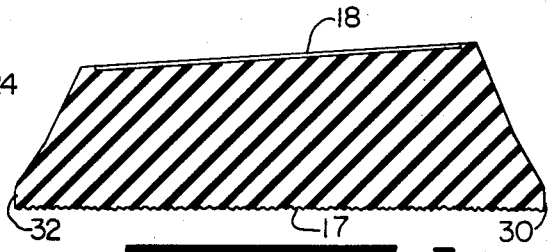
FIG. 3 is a sectional view taken about lines 3—3 of FIG. 1.

Referring in more detail to the drawings, there is illustrated in FIGS. 1 to 5 a preferred form of exercise unit 10 which is broadly comprised of a pair of upstanding pads or pedestals 12 which are united in juxtaposed relation to one another by a common base member 14 such that the longer dimension of the pads are arranged in closely-spaced parallel relation to one another and have a common, deep vertical groove 15 therebetween. The pad members 12 and base member 14 are of one piece or integral construction and are preferably composed of an open cellular foam material of substantially uniform density throughout which has the characteristics of being resilient but with sufficient strength to resist substantial deformation under the weight of a person's body. The resilient material of the pads and base member preferably is a non-skinning breathable urethane foam whose specific density varies to suit the weight of the user or types of usage or deflection desired. Preferably, the density of the foam ranges from two to four pounds per cubic foot.

The base member 14 includes a bottom surface 17 which is textured to define a non-skid bottom surface so as to afford superior traction on virtually any surface. For example, this is achieved in the molding process by placing a backing sheet especially textured to form a roughened bottom surface area. The bottom 17 permits the user to compress the entire exercise unit either while standing in front of, behind or on either side of the unit without slippage and thus afford a greater range of exercise activities.

Now considering in more detail a preferred construction and arrangement of pad member 12 and the common base 14, it will be noted that each pad member 12 is generally rectangular in horizontal section with the longer dimension of each extending parallel to the longer dimension of the other pad member and to the groove 15 therebetween. An upper or top, foot-engaging surface portion 18 is provided with closely spaced, longitudinally extending ribs 19 which traverse the substantial length of the surface 18, the ribs being surrounded by a ledge 20 both on the ends and sides of the surface portion 18 and which ledge projects slightly above the upper surfaces of the ribs 19. An inner sidewall 22 diverges or inclines downwardly from the inner side of the ledge 20, then extends vertically as at 23 to form one side of the groove 15. An outer sidewall 24 diverges or inclines downwardly from the outer side of the ledge 20 but at a lesser angle than the inclined sidewall 22 and terminates in a vertical side portion 25 of limited extend directly above the bottom surface 17. Front and rear end walls 26 and 28 correspondingly diverge or incline downwardly away from the upper surface portion 18 at a substantially corresponding angle, each front and rear end wall terminating in a vertical edge 30 and 32, respectively, at the front and rear ends of the base portion 14. As best seen from FIG. 3, the upper rib surface 18 slopes or inclines downwardly and rearwardly at a gradual angle. Thus, the front end wall 26 is of somewhat greater length than that of the rear end wall 28.

Figure 4:
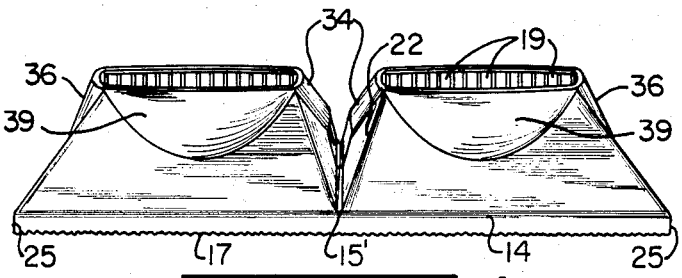
FIG. 4 is a rear view in elevation of the preferred form of the present invention.
Figure 5:
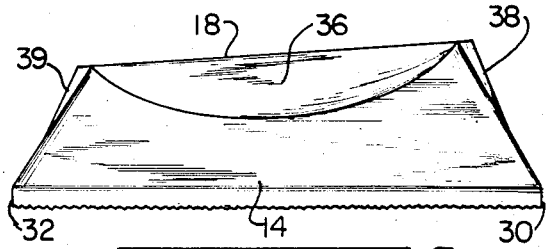
FIG. 5 is a side view in elevation of the preferred form of the present invention.

Each of the inner sidewalls 22 is interrupted by a convex bulge or radius 34 which, as best seen from FIGS. 1 and 4 protrudes away from the sidewall 22 into closely spaced confronting relation to the bulge 34 of the opposite inner sidewall 22 and merges into the vertical sidewall surface 23 of the common groove 15. Similarly, each outer sidewall 24 is interrupted by a convex bulge 36 which as best seen from FIGS. 1, 4 and 5 forms a downwardly divergent continuation of the ledge 20. In a like manner, convex bulges 38 and 39 form downward divergent continuations of the ledge 20 at the front and rear ends of the ribbed surface 18. The bulges 34, 36, 38 and 39 combine to control the compression and rebound time or response whereby to transfer the developed tension in response to deflection of the pad members 12 during the performance of an exercise. In particular, the bulges serve to increase the resistance to compression or downward deflection of the pad members and to improve lateral stability in response to lateral deflection imparted to the pad members 12. The compound groove 15 forms a separation between the pad members to a point substantially halfway between the upper ribbed surface portion 18 and bottom layer 16 so as to isolate compression of one pad member from the other. The outer ledge portion 20 in cooperation with the bulges 34, 36, 38 and 39 aids in maintaining the shape of the pad under compression and particularly to aid in stabilizing against lateral deflection.

Preferably, the bottom of the groove at 15' is formed with a radius to reduce stress and minimize any danger of tearing or splitting of the foam material in response to individual compression of the pad members. Similarly, the corners at the junctures of the sidewalls and end walls are rounded to better contain the cellular material as well as to cooperate in reducing undesirable, lateral deflection or shearing stress. The vertical walls 25 extend around the common base to lend further stability to the device especially when under maximum deflection so as to improve the resistance and handling characteristics of the unit. The non-skid, traction layer 17 permits the user to compress the entire exercise unit either while standing in front of, behind or on either side of the unit without slippage and thus afford a greater range of exercise activities and a greater degree of safety.

In use, the exercise unit 10 is placed on a flat surface, and an exercise position is chosen. For example, the exerciser may stand with each foot on one of the pad members 12 and jog in place in a manner such that the foot never leaves the surface of the pad so that the amount of travel or compression into the medium directly relates to the resiliency and density of the device. As each pad 12 is compressed, its upper ribbed surface 18 and ledges 20 are depressed while the interior cells of the foam material are compressed to afford multiple resistance to compression as well as to assist in the rebound phase of each cycle. The lateral compression of the cells is indicated in somewhat exaggerated form by the dotted lines 40 in the plan view of FIG. 1 to represent the degree of inward compression of opposite sides of each pad but with minimal inward compression at opposite ends, as designated at 40'. As each pad 12 is repetitively compressed, the active muscle fibers in the legs and ankles are brought into a state of exhaustion and, if the activity is continued, will progress into a deep muscular burn sensation. Here, the fresh muscle fibers are recruited to assist in sustaining this elevated level of contraction. Typical exercises which may be conducted, in addition to running and jogging as described, including running knee bends where each pad is alternatively compressed while running into and out of squatting positions, sit-ups in which the user may position the buttocks on the upper ribbed surface with the downward sloping portion facing forward and a wide range of other similar type exercises for the lower body and limbs.

Generally speaking, the neurological system automatically limits the degree to which the muscle fibers are allowed to interact, principally for increased injury protection by sensing the condition of the muscle. To some extent the neurological system can be limited so that more muscle fibers are allowed to participate in the exercise and further increase the potential velocity and force of contraction of each muscle. In this relation, the exercise unit 10 is precisely tuned to interact as an elastic buffer zone between the agonist/antagonist neuromuscular system so that increased velocity and contractile conditions will allow the user to reach speeds approaching 10 thrusts per second. Such exercising can be characterized as elastically induced, muscle fiber recruitment. Other specific muscular length fiber recruitment can be undertaken by assuming different body positions that occur in a particular athletic activity, each position utilizing muscles at specific contractile lengths. For example, it is possible to twitch recruit muscle fibers at a specific muscular lengths which lengths simulate that which is endured in a particular athletic endeavor. In a similar manner, certain body positions can be assumed to involve maximum fiber participation which is done by loading and contracting muscles as they approach their maximum lengths. In this respect, muscle fibers act somewhat like a nylon stocking: As the stocking is stretched, more and more fibers are drawn taut; and the more a muscle is lengthened, the more individual fibers are involved. The configuration of the pads 12 serves to channel the transfer of energy as millions of cells absorb, store and release the developed tension. In that the cells are simultaneously compressed and contained, they cooperate together in effecting a vastly improved support system for the foot.

Most desirably, the ribbed portions 19 along the top surface portion 18 of each pad are spaced apart on the order of $\frac{1}{8}''$ and each rib having a width on the order of $\frac{3}{8}''$ so as to optimally affect the metatarsel bones and toes of the foot. Thus, the ribbed foot pad creates a more active surface, and the increase of total surface area across the ribs enables the foot pad 12 to stretch or be compressed with less incidence of material stress. A particular benefit of this balanced resistance is the lack of muscle fiber tearing upon muscle fatigue so as to minimize any dangers inherent in the recruitment of specific muscle fibers.

The unitary curvilinear design of the exercise unit when combined with the specific density and rebound or resilient characteristics of the foam material enables the pads to conform to multiple compression sites and offer precise support for the knees and feet in performing different exercises.

It is therefore to be understood that various modifications and changes may be made in the construction and arrangement of parts comprising the various embodiments of invention as described herein without departing from the spirit and scope of the invention as defined by the appended claims and reasonable equivalents thereof.

I claim:

1. A portable, self-contained unit adapted for in-place exercising and strenthening the lower extremeities of the human body, comprising:

a pair of pad members each composed of a resilient, compressible material;

common base means composed of resilient compressible material uniting said pad members in juxtaposed relation to one another whereby to define a common groove between said pad members, said pad members and said base being of unitary construction and said compressible material being of substantially uniform density throughout said pad members and said base;

each said pad member having an upper foot-engaging surface integral with each said pad member, each said pad member being generally rectangular in horizontal cross-section and having downwardly divergent side and end walls extending continuously from said upper foot-engaging surface to said common base, said side and end walls interrupted by generally convex bulge portions extending the substantial length of each of said sidewalls and end walls, said convex portions being integral with said pad members and sloping downwardly from said upper foot-engaging surface, whereby said bulges improve the lateral stability of the pad members in response to lateral deflection imparted to said pad members.

2. A portable self-contained unit according to claim 1, said upper foot-engaging surfaces being sloped at an acute angle with respect to said base member and having spaced longitudinally extending ribs therein.

3. A portable self-contained unit according to claim 2, said common groove extending downwardly for substantially one-half the total depth of said exercise unit.

4. A portable self-contained unit according to claim 1, said convex portions being tapered downwardly into said sidewalls and end walls such that said sidewalls and end walls undergo inward contractile movement in response to a downward force applied to said upper foot-engaging surfaces of said pad members.

5. A portable self-contained unit according to claim 1, said pad members including said upper ribbed surfaces and base being of unitary one-piece construction and composed of a cellular foam material having a density in the range of two pounds to four pounds per cubic foot.

6. A portable self-contained unit according to claim 1, each said outer sidewall and end wall diverging downwardly from each said upper foot-engaging surface at an angle in the range of 110° to 120°.

7. A portable self-contained unit according to claim 6, each said inner sidewall diverging downwardly away from said upper foot-engaging surface at an angle in the range of 110° to 120° then extending vertically to form opposite sidewalls of said common groove.

8. A portable self-contained unit according to claim 1, each said pad member having ribs extending lengthwise along said upper foot-engaging surfaces, and a raised ledge in surrounding relation to said ribs.

9. A portable, self-contained exerciser unit for in-place exercising and strengthening of the lower extremities of the human body, comprising:

a pair of pad members each composed of a resilient, compressible open cellular foam material;

common base means composed of a resilient compressible material uniting said pad members in juxtaposed relation to one another with a common groove extending between said pad members; and each said pad member having an upper flat, foot-engaging ribbed surface formed out of and integral with each said pad member, each said pad member being generally rectangular in horizontal cross-section and having downwardly divergent side and end walls extending continuously from said upper ribbed surface to said common base, said side and end walls interrupted by generally convex bulges extending the substantial length of each of said sidewalls and end walls, said convex bulges being formed out of and integral with said pad members and extending downwardly from said upper ribbed surface, whereby said bulges improve the lateral stability of the pad members in response to lateral deflection imparted to said pad members.

10. A portable self-contained unit according to claim 1, said upper ribbed surfaces being sloped at an acute angle with respect to said base member.

11. A portable self-contained unit according to claim 10, said ribbed surfaces extending in a lengthwise direction.

12. A portable self-contained unit according to claim 9, said convex bulges being tapered in a direction such that said sidewalls and end walls undergo inward contractile movement in response to a downward force applied to said upper ribbed surfaces of said pad members.

13. A portable self-contained unit according to claim 12, said pad members including said upper ribbed surfaces and base being of unitary one-piece construction and composed of a cellular foam material having a uniform density in the range of two pounds to four pounds per cubic foot.

14. A portable self-contained unit according to claim 9, said common base including a bottom traction layer.

* * * * *